US009441805B2

(12) United States Patent
Godbillon

(10) Patent No.: US 9,441,805 B2
(45) Date of Patent: Sep. 13, 2016

(54) OPTICAL DEVICE, IN PARTICULAR FOR A MOTOR VEHICLE

(75) Inventor: Vincent Godbillon, Paris (FR)

(73) Assignee: Valeo Vision, Bobigny (FR)

( * ) Notice: Subject to any disclaimer, the term of this patent is extended or adjusted under 35 U.S.C. 154(b) by 758 days.

(21) Appl. No.: 13/574,915

(22) PCT Filed: Jan. 21, 2011

(86) PCT No.: PCT/EP2011/050849

§ 371 (c)(1),
(2), (4) Date: Oct. 12, 2012

(87) PCT Pub. No.: WO2011/092121

PCT Pub. Date: Aug. 4, 2011

(65) Prior Publication Data

US 2013/0021813 A1 Jan. 24, 2013

(30) Foreign Application Priority Data

Jan. 26, 2010 (FR) ..... 10 50489

(51) Int. Cl.

| | |
|---|---|
| ***F21V 21/00*** | (2006.01) |
| ***F21S 8/10*** | (2006.01) |
| *F21Y 105/00* | (2016.01) |

(52) U.S. Cl.

CPC ..... *F21S 48/1163* (2013.01); *F21S 48/125* (2013.01); *F21S 48/215* (2013.01); *F21S 48/2212* (2013.01); *F21Y 2105/00* (2013.01); *F21Y 2105/008* (2013.01)

(58) Field of Classification Search

CPC ..... B60Q 3/0283; B60Q 1/26; B60Q 3/002; B60Q 1/2607; B60Q 1/0011; B60Q 2400/10

USPC ..... 362/459–549

See application file for complete search history.

(56) References Cited

U.S. PATENT DOCUMENTS

| | | | |
|---|---|---|---|
| 6,639,360 | B2 | 10/2003 | Roberts et al. |
| 7,059,755 | B2 | 6/2006 | Yatsuda et al. |
| 7,073,931 | B2 | 7/2006 | Ishida |
| 7,131,758 | B2 | 11/2006 | Ishida |
| 7,232,247 | B2 | 6/2007 | Yatsuda et al. |
| 7,484,872 | B2 | 2/2009 | Yatsuda et al. |
| 7,950,837 | B2 | 5/2011 | Yatsuda et al. |
| 2002/0149312 | A1 | 10/2002 | Roberts et al. |
| 2004/0156209 | A1 | 8/2004 | Ishida |
| 2004/0208020 | A1 | 10/2004 | Ishida |
| 2005/0088853 | A1 | 4/2005 | Yatsuda et al. |
| 2005/0117347 | A1 | 6/2005 | Melpignano et al. |
| 2006/0120081 | A1 | 6/2006 | Yatsuda et al. |
| 2007/0263404 | A1 | 11/2007 | Yatsuda et al. |

(Continued)

FOREIGN PATENT DOCUMENTS

| | | |
|---|---|---|
| DE | 20207799 | 8/2002 |
| DE | 102007018985 | 10/2008 |
| DE | 102007018986 | 10/2008 |
| EP | 1485959 | 12/2004 |

(Continued)

*Primary Examiner* — William Carter

(74) *Attorney, Agent, or Firm* — Jacox, Meckstroth & Jenkins

(57) ABSTRACT

An optical device for automobile vehicles, notably a signalling and/or lighting device. The device comprises at least one surface-emitting light source, at least one lens, notably distant from the surface-emitting light source, disposed at least partially on the path of the light (R) emitted by the surface-emitting light source so as to produce an image of an object area of the surface-emitting light source.

23 Claims, 4 Drawing Sheets

(56) References Cited

U.S. PATENT DOCUMENTS

| | | | | |
|---|---|---|---|---|
| 2008/0285301 | A1* | 11/2008 | Wanninger et al. | 362/555 |
| 2009/0231875 | A1 | 9/2009 | Yatsuda et al. | |
| 2010/0008099 | A1* | 1/2010 | Inoue et al. | 362/520 |

FOREIGN PATENT DOCUMENTS

| | | |
|---|---|---|
| EP | 1526328 | 4/2005 |
| EP | 1970619 | 9/2008 |
| FR | 2853951 | 10/2004 |

* cited by examiner

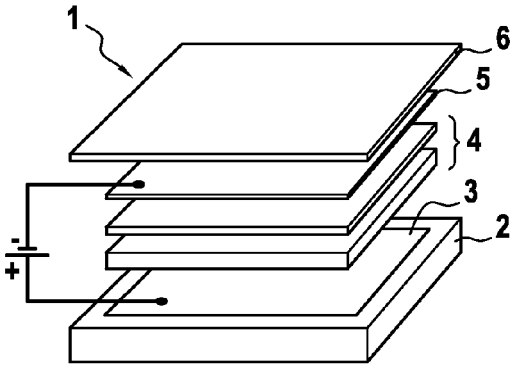
FIG.1
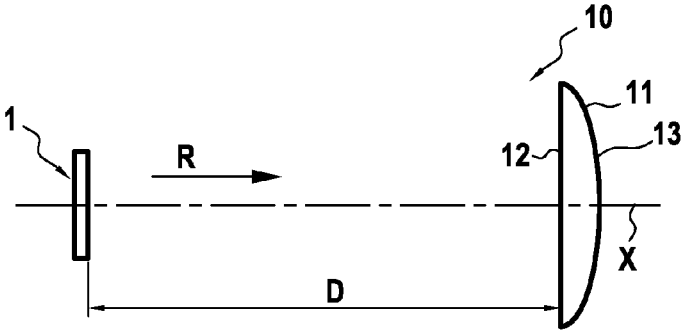
FIG.2
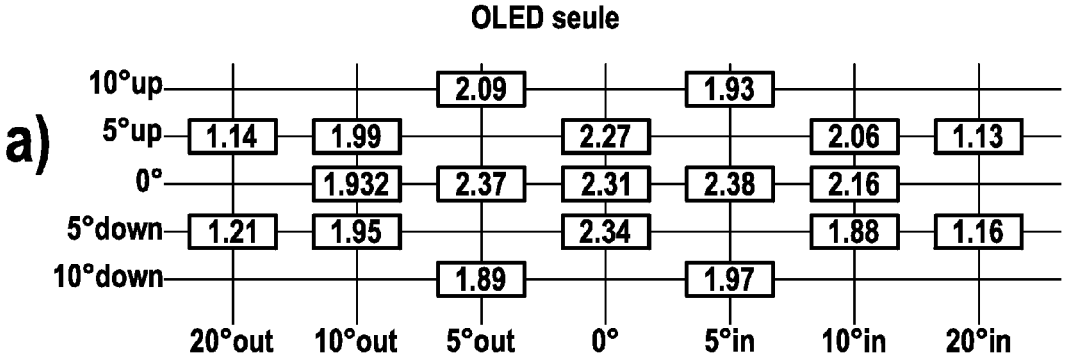
FIG.3
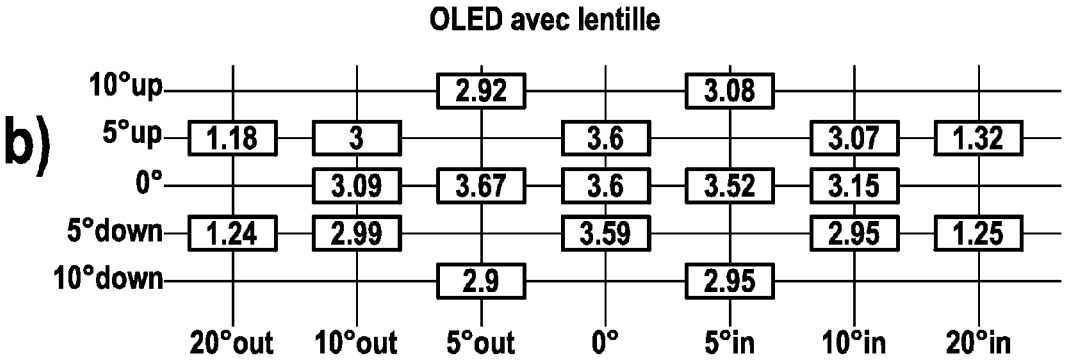

a)

b)

FIG.8
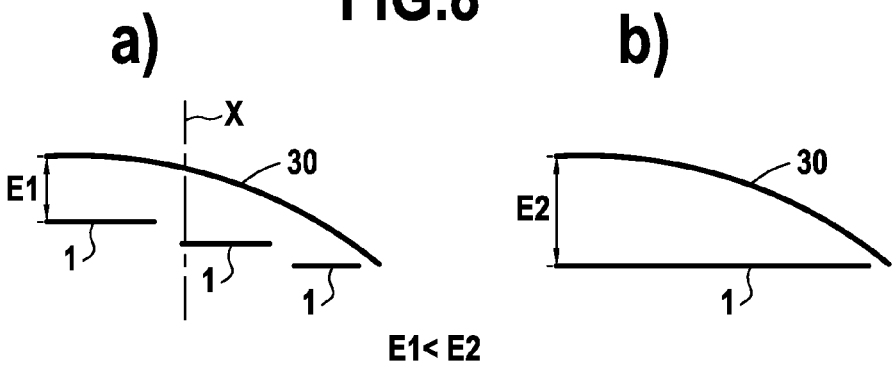
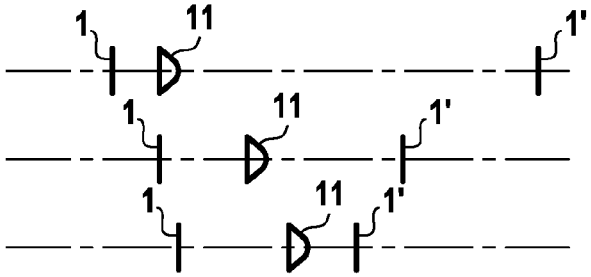
FIG.9
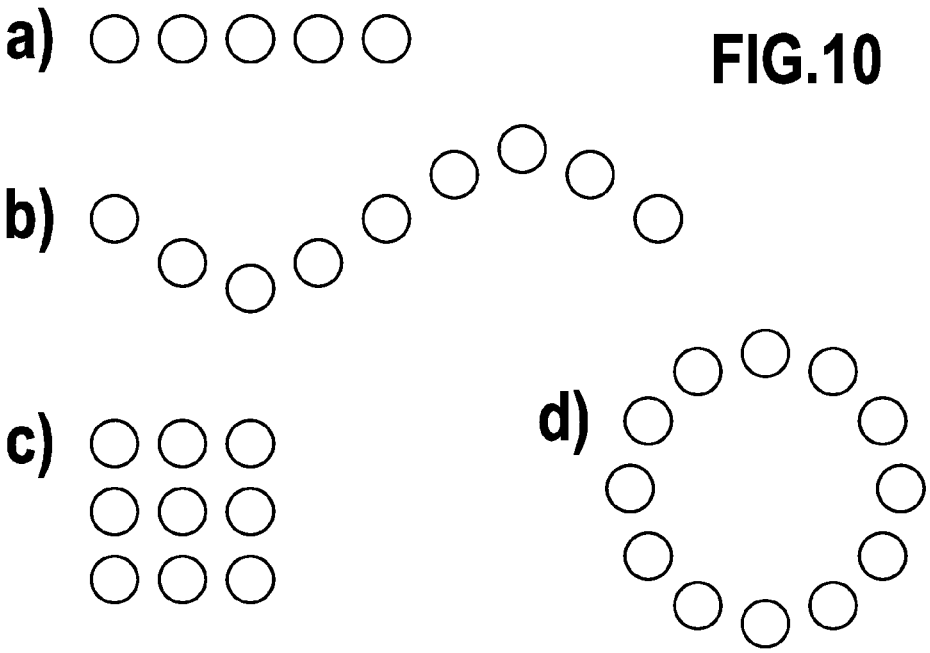
FIG.10

OPTICAL DEVICE, IN PARTICULAR FOR A MOTOR VEHICLE

CROSS-REFERENCE TO RELATED APPLICATIONS

This application claims priority to PCT Application PCT/EP2011/050849 filed Jan. 21, 2011, and also to French Application No. 1050489 filed Jan. 26, 2010, which applications are incorporated herein by reference and made a part hereof.

BACKGROUND OF THE INVENTION

1. Field of the Invention

The invention concerns an optical device, notably for a motor vehicle, such as a lighting and/or signaling device having in particular a photometric function useful for circulation of the vehicle on roads, enabling the vehicle to be seen by other vehicles or the driver of the vehicle to see outside.

2. Description of the Related Art

It is known, in particular from the document DE 10 2007 018 985, which document is incorporated herein by reference and made a part hereof, to use surface-emitting light sources, in particular an organic light-emitting diode, as the light source of a motor vehicle signaling device. An organic light-emitting diode-type light source of this kind enables provision of homogeneous light.

The brightness of an organic light-emitting diode of the present-day technology may not be sufficient to provide some signaling functions (such as "side light", "brake light" and "high-level brake light" signaling functions). An organic light-emitting diode of the present-day technology typically provides a brightness of 1000 Cd/m$^2$ whereas a brightness of 5000 to 10 000 Cd/m$^2$ would be required for the aforementioned functions.

There is known from the document DE 10 2007 018 986, which document is incorporated herein by reference and made a part hereof, a motor vehicle passenger compartment lighting device comprising a set of organic light-emitting diodes to which optical elements are stuck.

Vehicle signaling device are known from the documents DE 202 07 799 and EP 1 485 959, which are equivalent to U.S. Patent Publication 2005/0117347, which documents are incorporated herein by reference and made a part hereof.

To summarize, organic light-emitting diodes can have the following features:

homogeneous light emission, substantially plane light-emitting surface, relatively low brightness.

Although the first characteristic is favorable (because homogeneous light is appreciated by motor vehicle manufacturers, for example), the other two characteristics may be problematic in that a light is often curved. Moreover, the statutory minimum luminous intensity values (4 Cd for a headlamp) would impose large light-emitting areas.

SUMMARY OF THE INVENTION

The invention aims in particular to remedy the drawbacks referred to above.

There is, therefore, a need to provide a device, system and process that overcomes or more of the problems mentioned earlier.

The invention therefore provides an optical device for motor vehicles, notably a signaling and/or lighting device, this device including:

at least one surface-emitting light source, at least one lens, notably distant from the surface-emitting light source, disposed at least partially on the path of the light emitted by the surface-emitting light source so as to produce an image of an object area of the surface-emitting light source.

The image may be formed at infinity or in front of the lens or behind it.

The invention enables certain effects, notably of depth, to be obtained by adjusting the relative position of the source and the lens, the size of the source and the focal length of the lens.

The invention makes it possible in particular to increase the emitted luminous intensity and/or to create an effect of depth.

The surface-emitting light source is preferably an organic light-emitting diode (OLED).

The light-emitting area of the surface-emitting light source may be greater than 1 cm$^2$, even 10 cm$^2$.

The device preferably includes a plurality of lenses associated with one or more surface-emitting light sources, these lenses having different focal lengths and/or being disposed at different distances from the surface-emitting light source or sources to create a plurality of images.

These lenses are preferably disposed at different axial positions with respect to a given optical axis.

The lens or each lens may for example have a meniscus shape, or alternatively have a plane entry face and a convex exit face, or alternatively have convex entry and exit faces.

In one embodiment of the invention the surface-emitting light source or sources define(s) a plurality of object areas and the device includes a plurality of lenses each associated with one of the object areas to form an image of that object area.

These object areas may be plane or non-plane; for example one of these object areas may be at least locally in relief.

If required, the lenses are formed on a common part produced in one piece.

This enables a simpler design of device because fewer parts are necessary.

Alternatively, the lenses are produced on separate parts.

For example, the device includes at least three lenses, notably of different focal lengths, associated with the surface-emitting light source or sources.

If necessary, the object areas of the surface-emitting light sources lie in substantially the same plane, this plane notably being substantially perpendicular to an optical axis of the device.

In one embodiment of the invention the device is, notably the lenses are, arranged to form images corresponding to the object areas, which images are offset relative to each other along the optical axis, notably to create an effect of depth.

If required, the object areas of the surface-emitting light sources are disposed at different positions along the optical axis of the device.

Thus the plurality of light sources may be disposed at different positions along the optical axis of the device.

In one embodiment of the invention the lenses are arranged to form images corresponding to the object areas, which images are in substantially the same plane and/or substantially joined to each other.

The object area and/or its image produced by the lens preferably has or have a shape chosen from: polygonal (for example rectangular), curved (for example circular or oval), annular, etc.

The object area, or even the surface-emitting light source, advantageously has an area smaller than that of the corresponding lens.

Thus the invention offers various advantages:

source of small size and therefore lower cost, in association with the lens, efficiency is improved, i.e. the shape of the beam and the on-axis luminous intensity are improved, the source may be of comparable size to the lens, compared to the usual lamp-based technologies, the use of surface-emitting sources further enables the use of a collimator system (parabolic reflector, additional Fresnel lens, etc) to be dispensed with; filament type "point" sources are generally not used on their own with lenses for reasons of low efficiency and unsatisfactory luminous appearance.

In one embodiment of the invention, there is only one surface-emitting light source that forms a plurality of object areas, preferably associated with a plurality of lenses.

Alternatively, each object area is associated with its own surface-emitting light source.

The lens is preferably adapted to increase the luminous intensity in a predetermined region, notably substantially at the center of the beam.

This enables the relatively low brightness to be alleviated. Thus, to obtain equivalent photometry, cost may be reduced by using sources of smaller size than when an OLED is used on its own.

Moreover, if required, at least one of the lenses may be a Fresnel lens.

The sources may be on planes inclined relative to the axis of the vehicle and the lenses are placed on a prism to redirect the beam along the vehicle axis.

If necessary, the source is defocused, notably axially, with respect to the lens.

If necessary, the device is arranged as a signaling device, notably for a turn indicator light, a stop light or a side light.

The surface-emitting light source preferably includes an organic light-emitting diode (OLED) or may instead include a lamp or an LED (light-emitting diode provided with a chip of small size) associated with an optical diffuser, this lamp or LED being placed behind the optical diffuser, which is adapted to diffuse the light from this lamp or LED.

These and other objects and advantages of the invention will be apparent from the following description, the accompanying drawings and the appended claims.

BRIEF DESCRIPTION OF THE ACCOMPANYING DRAWINGS

The invention may be understood better after reading the following detailed description of nonlimiting embodiments of the invention and examining the appended drawings, in which:

FIG. 1 shows partially and diagrammatically an example of the structure of an organic light-emitting diode;

FIG. 2 shows partially and diagrammatically a device of one embodiment of the invention;

FIG. 3 shows photometry charts for an OLED on its own and an OLED with a lens, as shown in FIG. 2;

FIG. 8 shows partially and diagrammatically from above devices of embodiments of the invention;

FIGS. 9 and 10 show partially and diagrammatically devices of further embodiments of the invention.

DETAILED DESCRIPTION OF THE PREFERRED EMBODIMENTS

Figure 4:
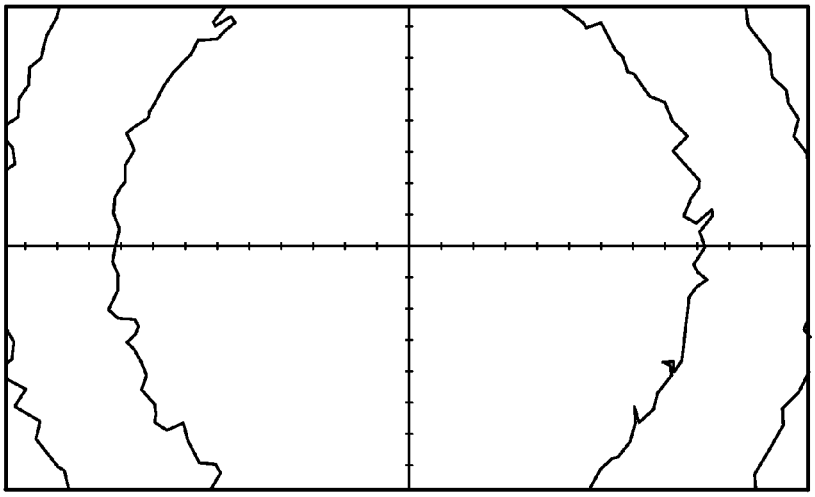
FIG. 4 shows diagrams a) and b) which are iso-candela curves for the source alone and for the source associated with the lens, respectively.

There has been represented in FIG. 1 an organic light-emitting diode adapted to form a surface-emitting light source 1 as that term is used in the context of the present invention.

This surface-emitting light source 1 includes:

a substrate 2, for example of glass, an anode 3 deposited on this substrate 2, a plurality of organic layers 4 within which light can be generated, a cathode 5, for example in aluminum, an encapsulation layer 6.

These various elements are superposed, forming a sandwich structure with a thickness of approximately 200 nm, for example.

Light is generated within the organic layers 4 when an electric current flows between the anode 3 and the cathode 5 through the organic layers 4.

Of course, the surface-emitting light source 1 in the sense of the present invention may employ a technology other than the OLED technology.

There has been represented in FIG. 2 a device 10 conforming to one embodiment of the invention including a surface-emitting light source 1, for example an OLED, and a lens 11 placed in front of the surface-emitting light source 1 on an optical axis X.

The lens 11 has a plane entry face 12 and a convex exit face 13.

The reference R designates a light ray coming from the surface-emitting light source, or OLED 1.

The reference D designates the distance between the surface-emitting light source 1 and the lens 11.

The diagram a) in FIG. 3 is a photometry chart for the OLED 1 on its own.

The diagram b) in FIG. 3 is a photometry chart obtained with the OLED 1 and the lens 11 placed in front of it in accordance with the invention.

As can be seen, the invention enables the photometric distribution to be optimized and thus the efficiency of the optical device 10 to be increased.

Thus it is possible to reduce the area of the surface-emitting light source 1. OLED sources being costly, and the cost increasing with the area of the surface-emitting light source 1, it is important to optimize their use.

Furthermore, the homogeneity of the OLED 1 is more guaranteed if its dimensions are small. This is an additional argument for seeking to reduce its area.

In the example described, the OLED 1 is centered on the optical axis X and its dimensions are 20 mm wide and 12 mm high.

The plane/convex lens 11 is focused on the center of the surface-emitting light source 1.

Its entry face 12 is situated at a distance D of 17 mm from the surface-emitting light source 1.

Its diameter is 40 mm.

Diagrams a) and b) in FIG. 4 shows iso-candela curves for the surface-emitting light source 1 on its own and for the surface-emitting light source 1 associated with the lens 11, respectively.

That for the surface-emitting light source 1 on its own (case a) in FIG. 4) has symmetry of revolution, as indicated.

The photometry charts to be filled in being generally larger horizontally than vertically, light is lost upward and downward.

When the lens 11 is added, the beam assumes a substantially rectangular shape much better suited to the regulations (case b) in FIG. 4).

The photometric levels are moreover higher. To be more precise, on comparing the photometry charts (diagrams a) and b) in FIG. 3), it is seen that the improvement is more than 50% at the center whilst preserving values similar to 20°.

In the example described with reference to FIG. 3B, the surface-emitting light source 1 is preferably situated +/−7 mm from the focal point of the lens 11 for axial defocusing.

It is found that the proposed solution is particularly robust from the point of view of the position of the surface-emitting light source 1, which is a great advantage.

Figure 11:
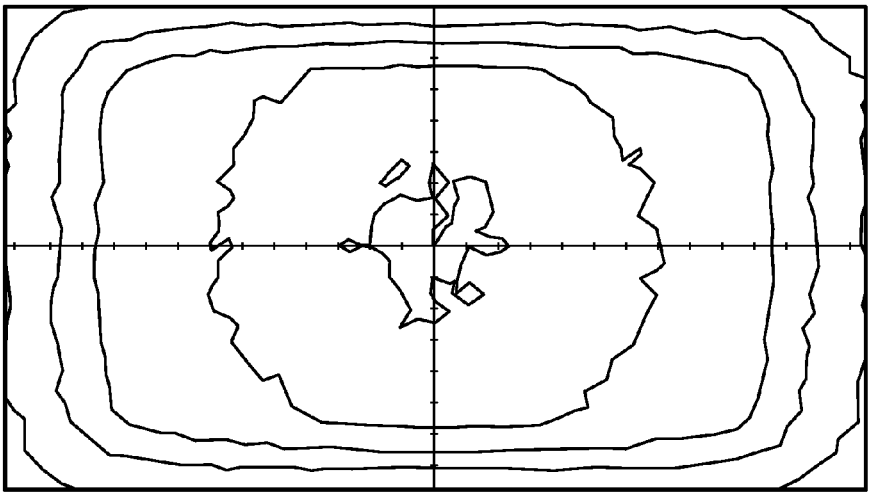
FIG. 11 shows three luminous intensity curves.
Figure 11:
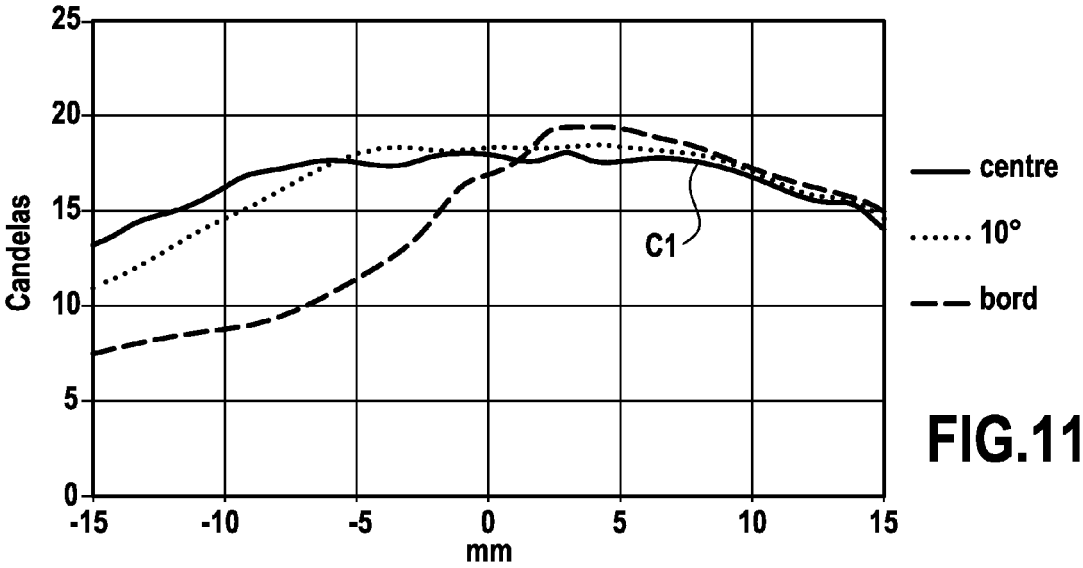

Three curves are shown in FIG. 11.

The first curve C1 corresponds to the sum of the following five photometric points: H−5°, HV, H+5°, V−5° and V+5°.

C1 gives an idea of the quantity of light directed toward the center of the beam.

The second curve C2 corresponds to the sum of the following six photometric points: H−10°V+5° (point 10° to the left and 5° up), H−10°V0°, H−10°V−5°, H+10°V+5°, H+10°V0°, H+10°V−5°.

C2 gives an idea of the quantity of light directed into the intermediate areas of the beam.

The third curve C3 corresponds to the sum of the following eight photometric points: H−20°V+5°, H−20°V−5°, H−5°V+10°, H−5°V−10°, H+20°V+5°, H+20°V−5°, H+5°V+10°, H+5°V−10°.

C3 gives an idea of the quantity of light directed toward the edges of the beam.

For the three curves, the abscissa axis corresponds to the value of axial defocusing expressed in mm, positive values being used when the source moves toward the lens 11.

The ordinate axis represents the sum of the intensities (in candelas) of the photometric points referred to above.

It is seen that the photometry at the center of the beam is very stable, at least in the area from −10 to +10 mm.

The photometry of the intermediate areas of the beam is also very stable, between −5 and +10 mm.

Finally, the photometry of the edge of the beam also has good stability, between 0 and +10 mm this time.

Beyond these areas, the fall-off noted remains sufficiently limited over several millimeters for the minima imposed by the regulations still to be complied with.

Thus an axial defocusing of +/−7 mm may be considered acceptable.

It is therefore seen that the tolerance on defocusing is very wide, thus facilitating industrialization of the product.

Figure 5:
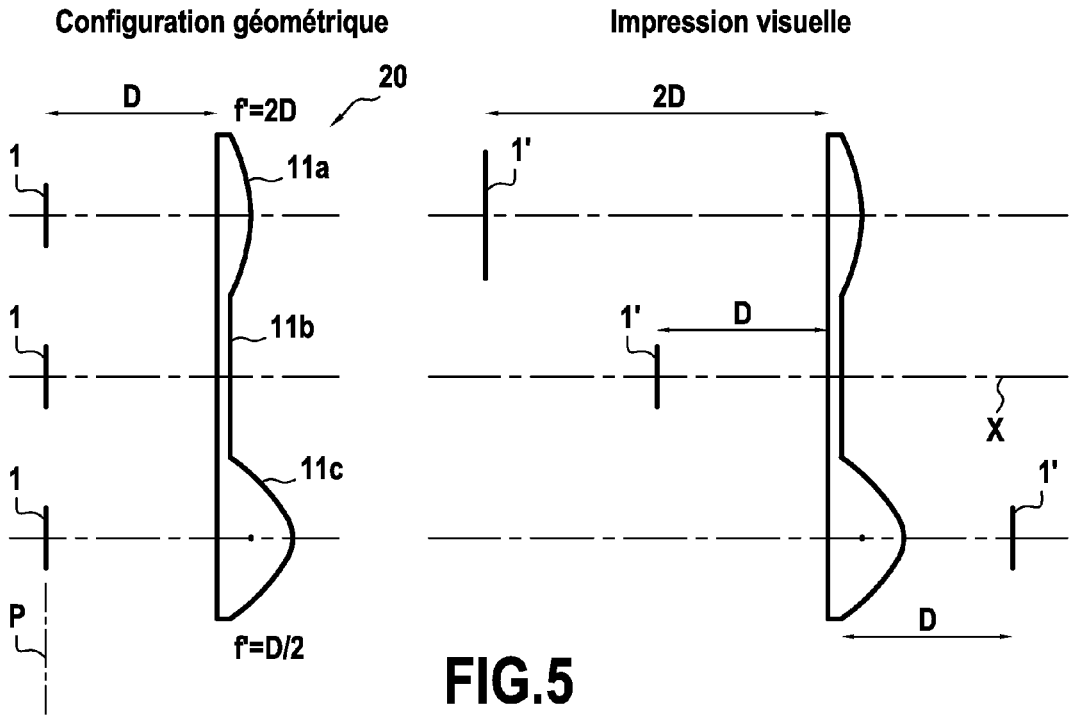
FIG. 5 shows partially and diagrammatically an optical device of another embodiment of the invention.

An example of an optical device 20 of the invention is represented in FIG. 5 (to be more precise on the left in FIG. 5).

The top lens 11*a* has a focal length f' twice the distance D at which the surface-emitting light source 1 is situated.

The center lens 11*b* is neutral. It is a plate with parallel faces.

The bottom lens 11*c* has a focal length f' half the distance D from the surface-emitting light source 1.

The effect for the observer (as shown on the right in FIG. 5) is that the top surface-emitting light source 1 (in fact its image 1') is pushed back.

The center surface-emitting light source 1 (in fact its image 1') is unchanged.

The bottom surface-emitting light source 1 (in fact its image 1') appears to be situated in front of the light.

Thus a volume effect is obtained.

The surface-emitting light sources 1 seem to be situated at locations staggered in depth. In reality, they are all situated in the same plane P.

The optical device 20 may form a headlamp or a stop light, etc.

Of course, the invention is not limited to the embodiment that has just been described.

Figure 6:
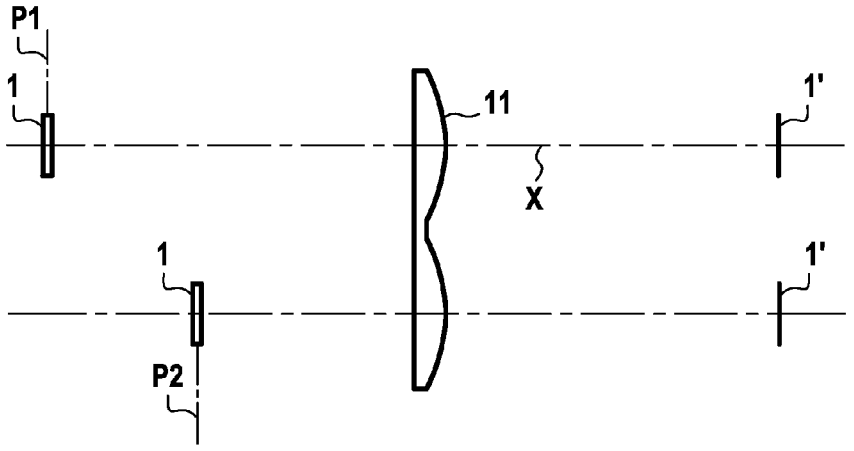
FIGS. 6 and 7 show partially and diagrammatically devices of further embodiments of the invention.

For example, as shown in FIG. 6, the surface-emitting light sources 1 may themselves be situated in planes P1 and P2 staggered along the optical axis X, to follow the curve imposed by the vehicle.

In this case the reverse configuration could be used, giving the visual impression that the surface-emitting light sources 1 are all situated in the same plane P.

Figure 7:
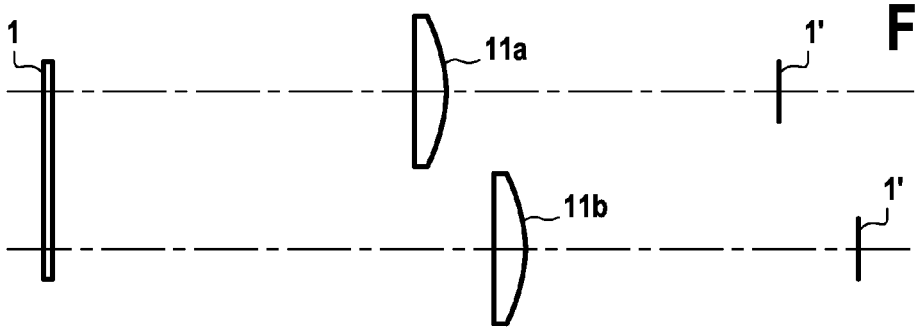

In another embodiment of the invention, as shown in FIG. 7, there is only one surface-emitting light source 1 and the optical device 10 includes two distinct lenses 11*a* and 11*b* associated with that source, to form two distinct images 1'.

In a variant of the invention, the optical device 10 may be adapted to be used inside the passenger compartment of the motor vehicle, for example as a decorative or lighting interior light.

For example, the plurality of surface-emitting light sources 1 may be disposed at different positions along the optical axis X of the optical device 10 (FIG. 8A).

This is shown in FIG. 8 in which it is seen that the distance E1 between the leftmost surface-emitting light source 1, for example, of a plurality of surface-emitting light sources 1 offset axially, and a cover glass 30 of the optical device 10 (FIG. 8A) is smaller than the distance E2 between the single surface-emitting light source 1 and the cover glass 30 (FIG. 8B).

The invention enables optimum adaptation to the curvature of the lamp and thus reduces the overall size.

In another embodiment shown in FIG. 9, the surface-emitting light sources 1 are in different planes and likewise the lenses 11.

The visual impression of the images 1' follows a curve different from the disposition of the surface-emitting light sources 1 and the lenses 11.

As seen from the front, the lenses 11 may be arranged on curves or surfaces. FIG. 10 shows a few examples:

along a straight line segment (FIG. 10A), along an undulation or a wave (FIG. 10B), in a matrix, for example a rectangular or square matrix (FIG. 10C), along a circle or a ring (FIG. 10D).

While the system, apparatus, process and method herein described constitute preferred embodiments of this invention, it is to be understood that the invention is not limited to this precise system, apparatus, process and method, and that changes may be made therein without departing from the scope of the invention which is defined in the appended claims.

What is claimed is:

1. An optical device for automobile vehicles, notably a signaling and/or lighting device, said optical device comprising:

at least one surface-emitting light source; and a plurality of lenses distant from said at least one surface-emitting light source, disposed at least partially on a path of the light (R) emitted by said at least one surface-emitting light source so as to produce an image of an object area of said at least one surface-emitting light source, said at least one surface-emitting light source having said object area being substantially polygonal and of a size and dimension to provide light to each of said plurality of lenses;

wherein a light emitting area of said at least one surface-emitting light source is greater than 1 $cm^2$;

wherein said at least one surface-emitting light source is an organic light-emitting diode that emits a substantially even distribution of light in a beam;

wherein each of said plurality of lenses is adapted to receive; at least a portion of said substantially even distribution of light and increase a luminous intensity in a predetermined region of at least a portion of said beam.

2. The optical device claimed in claim 1, wherein said plurality of lenses associated with one or more of said at least one surface-emitting light sources have different focal lengths and/or being disposed at different distances from said at least one surface-emitting light source or sources.

3. The optical device claimed in claim 2, wherein said object area of said at least one surface-emitting light sources are disposed at different positions along an optical axis (X) of said optical device.

4. The optical device claimed in claim 2, wherein said object area has an area smaller than that of the corresponding lens.

5. The optical device claimed in claim 1, wherein said at least one surface-emitting light source or sources define(s) a plurality of object areas and said plurality of lenses each being associated with one of said plurality of object areas to form an image of one of said plurality of object areas.

6. The optical device claimed in claim 5, wherein said plurality of lenses are formed on a common part produced in one piece, for example by molding.

7. The optical device claimed in claim 1, wherein said plurality of lenses are formed on a common part produced in one piece, for example by molding.

8. The optical device claimed in claim 7, wherein said object area of said at least one surface-emitting light sources lie in substantially the same plane.

9. The optical device claimed in claim 7, wherein said object area has an area smaller than that of the corresponding lens.

10. The optical device claimed in claim 7, wherein it constitutes a motor vehicle signaling device.

11. The optical device claimed in claim 7, adapted to be used inside a passenger compartment of an automobile vehicle, for example decoration or lighting interior light or indicator lamp.

12. The optical device claimed in claim 7, wherein a light emitting area of said at least one surface-emitting light source is greater than 10 $cm^2$.

13. The optical device claimed in claim 1, wherein said object area of said at least one surface-emitting light sources lie in substantially the same plane.

14. The optical device claimed in claim 13, wherein said plurality of lenses are arranged to form images corresponding to said object area, which images are offset relative to each other along an optical axis to create an effect of depth.

15. The optical device claimed in claim 1, wherein said object area of said at least one surface-emitting light source is disposed at different positions along an optical axis (X) of said optical device.

16. The optical device claimed in claim 15, wherein said plurality of lenses are arranged to form images corresponding to said object area, which images are in substantially the same plane and/or substantially joined to each other.

17. The optical device claimed in claim 1, wherein said object area has a shape chosen from polygonal, curved, annular, oval, or the like.

18. The optical device claimed in claim 1, wherein said object area has an area smaller than that of the corresponding lens.

19. The optical device claimed in 1, wherein said at least one surface-emitting light source is defocused axially relative to said plurality of lenses.

20. The optical device claimed in claim 1, wherein it constitutes a motor vehicle signaling device.

21. The optical device claimed in claim 1, adapted to be used inside a passenger compartment of an automobile vehicle, for example decoration or lighting interior light or indicator lamp.

22. The optical device claimed in claim 1, wherein a light emitting area of said at least one surface-emitting light source is greater than 10 $cm^2$.

23. The optical device claimed in claim 1, wherein said plurality of lenses are arranged in different planes to form images that are offset relative to each other.

* * * * *